US005931702A

United States Patent [19]

Fladung

[11] Patent Number: 5,931,702

[45] Date of Patent: Aug. 3, 1999

[54] ELECTRICAL OUTLET IN-LINE TAP

[75] Inventor: Phil Fladung, Carnel, Ind.

[73] Assignee: Woods Industries, Inc., Carmel, Ind.

[21] Appl. No.: 08/908,856

[22] Filed: Aug. 8, 1997

[51] Int. Cl.[6] ..... H01R 25/00; H01R 13/62

[52] U.S. Cl. ..... 439/652; 439/654; 439/369

[58] Field of Search ..... 439/652, 654, 439/510, 359, 369, 345, 451, 455, 456

[56] References Cited

U.S. PATENT DOCUMENTS

| | | | |
|---|---|---|---|
| 3,383,639 | 5/1968 | Anderson et al. | 439/369 |
| 3,609,638 | 9/1971 | Darrey | 339/75 |
| 4,183,603 | 1/1980 | Donarummo | 339/75 |
| 5,004,435 | 4/1991 | Jammet | 439/652 |
| 5,071,367 | 12/1991 | Luu | 439/501 |
| 5,255,866 | 10/1993 | Campolo | 439/369 |
| 5,562,488 | 10/1996 | Neiser et al. | 439/652 |
| 5,582,524 | 12/1996 | Sanner et al. | 439/369 |

*Primary Examiner*—Paula Bradley
*Assistant Examiner*—Briggitte R. Hammond
*Attorney, Agent, or Firm*—McAndrews, Held & Malloy, Ltd.

[57] ABSTRACT

An electrical outlet in-line tap with a cord securement mechanism for preventing separation of two electrically connected electrical cords while also able to provide electrical power to at least one additional electrical socket. A base member is provided with multiple electrical sockets. The tap provides an electrical power-in plug adapted to receive electrical power from a receptacle end of an electrical power supply cord. A cord securement device is provided including an eyelet in which to receive a loop of the power supply cord. The core securement mechanism also includes a hinged gate which allows passage of the power supply cord through the eyelet when the gate is up and which prevents passage of the power supply cord through the eyelet when the gate is down. Once electrical power is provided through the power-in plug, electrical devices connected to the electrical sockets on the tap receive power. Also provided is an electrical power-out socket adapted to convey electrical power to a plugged in device, which may be another in-line tap, through a power-out cord. A cord securement device, as described above, is also provided to maintain the plugged together relationship between the power-out cord and the power-out socket.

13 Claims, 2 Drawing Sheets

27
23
25
33
17
21
19
35
13
29
11
31
15

47
43
53
39
51
55
45
49
61
27
39
19
59
40
44
57
37
50
16c
42
16b
16a
18
52

ELECTRICAL OUTLET IN-LINE TAP

CROSS-REFERENCE TO RELATED APPLICATIONS

A design patent application, Ser. No. 29/074,796 filed on even date herewith and having the same inventor and owned by the same entity, is incorporated herein by reference.

STATEMENT REGARDING FEDERALLY SPONSORED RESEARCH OR DEVELOPMENT

Not applicable.

FIELD OF THE INVENTION

This invention relates to a device for preventing separation of two electrically connected electrical cords. More specifically, this invention relates to a device for providing electrical cord securement to hold two electrically interconnecting electrical cords together without imposing unnecessary forces on the cords themselves while also providing the electrical power at the cord interface to power a plurality of electrical sockets.

BACKGROUND OF THE INVENTION

Power tools and other portable electrical equipment are generally equipped with relatively short electrical power cords having a male plug at the end thereof. However, a longer power cord is often required to provide power to the tools in an area remotely located from an electrical outlet. As a result, power tools are frequently connected to remote outlets via extension cords. An extension cord is an electric cord fitted with a male plug at one end and a female receptacle at the other end. The female receptacle end of the extension cord is mated with the male plug of the power tool cord. The male plug of the extension cord is inserted into a conventional outlet, providing an electrical connection between the outlet and the power tool. Additionally, numerous extension cords may be connected together, extending the distance of the electrical connection between power tools and remote outlets.

Electrical cords maintain a plugged together relationship between prongs of the male plug and corresponding receptacles of the female socket through friction. The friction between the plug and socket is adequate to maintain the electrical cords in a plugged together relationship when the cords are stationary. However, the friction between the plug and socket may be insufficient to hold the electrical cords together when the cords are moved around, such as at a construction site. In the latter situation, the insufficient friction between the plug and socket causes them to accidentally separate, interrupting the flow of electricity to the power tool. The interruption of the flow of electricity to the tool can be annoying and time consuming, and sometimes possibly dangerous in certain situations. For example, if the power is intermittent because of a poor connection, the operator of the tool may believe that the tool is not powered when in fact power could be reapplied at any time.

Numerous inventions have been devised to solve the problem of accidental separation of the male plugs and female sockets of electrical cords. One solution has been the use of a device that clamps the male plugs and female sockets together. A device that clamps plugs and sockets together is disclosed in U.S. Pat. No. 4,183,603, issued to Carmo. The Carmo patent shows various mechanisms for holding the connection between the plugs and socket, including, for example, a thumbwheel which is rotated to firmly press the male plug and the female socket together. Another device that holds the connection between plugs and socket is disclosed in U.S. Pat. No. 3,383,639, issued to Anderson et al. The Anderson patent shows an extension cord coupling clamp conforming around the ends of the male plugs and female sockets to keep them connected. These devices, however, place an undue amount of strain on the connection of the plugs and sockets, to the wire, and, therefore, may damage the plugs and sockets or the electrical cords.

Accordingly, some devices have been constructed to relieve, at least partially, the strain on the connection by clamping the electrical cords without imposing unnecessary forces on the plugs and sockets themselves. For example, a strain relief device having a pair of clamps connected by a threaded rod extension is disclosed in U.S. Pat. No. 3,609,638, issued to Darrey. Each clamp securely grips the electrical cord with the connected male and female ends disposed therebetween. Such devices which employ a clamp or similar apparatus may damage the electrical integrity of the conductors, the insulation, or the cover of the extension cord.

Other strain relief devices have been constructed without the use of potentially damaging clamps. In U.S. Pat. No. 5,255,866, issued to Campolo, a stain relief device is disclosed consisting of a rigid hollow cylinder with two rigid flanges extending at opposite ends of the cylinder. The joined plug and socket of two electrical cords are positioned inside the cylinder. Each respective cord is bent back through slots in the flanges and wound around the cylinder between the flanges, thereby transmitting tension between the electrical cords to the cylinder and flanges. However, these devices waste a considerable amount of the extension cord due to the necessity of winding the cord around the device to transfer the strain from the cord to the device. In addition, devices such as the one disclosed by Campolo prevents visual inspection of the connection between the two cords.

A device that provides for visual inspection of the connection between the two electrical cords without the use of clamps and without inducing unnecessary forces on the plugs and sockets themselves and without wasting a considerable amount of the extension cord is disclosed in U.S. Pat. No. 5,582,524 issued to Sanner et al. The Sanner patent discloses a device comprised of a base member having a pair of eyelets, each eyelet defining an opening of a size for allowing the passage of a looped electrical cord. A pair of hook members are secured to the base member and spaced from the eyelets. Each hook member is shaped for receiving the looped portion of the electrical cord.

However, the Sanner device, although a vast improvement over the previous art, may still not be optimal in terms of minimizing the length of the electrical cord necessary to secure the electrical cord with the Sanner device.

Also, the Sanner device provides for a one-to-one connectivity; i.e., one male plug connected to one female socket. Possibly of more use in the setting of a busy commercial construction site is one-to-plurality connectivity; e.g., an active electrical cord runs from the electrical supply to the device which then serves as a "tap" to provide electrical power to a plurality of other electrical cords. It is important that all of the electrical cords connected to the tap are maintained in a plugged together relationship.

Therefore, it is an object of this invention to provide a device with a practical construction for maintaining the connection between male plugs and female sockets while not imposing undue strain on the plugs and sockets.

It is also an object of the present invention to provide a device with a practical construction for preventing the separation of two electrical cords which minimizes the amount of electrical cord necessary to secure the cord with the device.

Another object of the invention is to provide a device with a practical construction for preventing the separation of two electrical cords which provides for the complete elimination of any slippage of the electrical cords out of the cord securement member.

Another object of the invention is to provide a device with a practical construction for preventing the separation of two electrical cords which is able to function as a "tap" to provide electrical power to a plurality of electrical sockets.

Another object of the present invention is to provide a device as described above which can be manufactured easily and at a low cost from commercially available materials.

Another object of the present invention is to provide a device as described above which prevents the cords from becoming worn or damaged.

Another object of the present invention is to provide a device as described above which allows the user to easily visually inspect the integrity of the connection of the electrical cords.

These and other objects and advantages of the present invention will become apparent from the following description.

BRIEF SUMMARY OF THE INVENTION

A cord securement device is set forth that overcomes the foregoing problems. The preferred embodiment of the device is comprised of a base member having a pair of eyelets, each eyelet defining an opening of a size to allow the passage of a looped electrical cord. A pivoting gate is attached to each eyelet. After the passage of the respective loop of electrical cord, the respective pivoting gate is pivoted downwardly for setting in a securement fixture on the base member. Thus set, the gate forms a barrier to the removal of the electrical cord loop preventing the electrical cord loop from being dislodged during even the most vigorous usage.

The female electrical socket of the active (electrically powered) electrical cord is plugged directly into the device via a male plug. The electrical power is supplied to a female electrical socket of the device which is capable of receiving the male end of a second electrical cord which may also be secured. The preferred embodiment of the device provides for five separate female electrical sockets.

The cord securement device prevents the separation of the electrical cords through strain relief from the cords to the device without physically clamping or crimping the electrical cords. The device also allows the user to visually examine the integrity of the connection between the electrical cords and the device. The usage of the pivoting gate eliminates any slippage of the electrical cords out of the cord securement member. The present configuration of the securement device also minimizes the length of electrical cord necessary to secure the electrical cord. The securement device's five female electrical sockets also provide for the additional connectivity of a "tap" desirable in a commercial construction environment.

These and other advantages and novel features of the present invention, as well as details of an illustrated embodiment thereof, will be more fully understood from the following description and drawings.

DETAILED DESCRIPTION OF THE INVENTION

Figure 1:
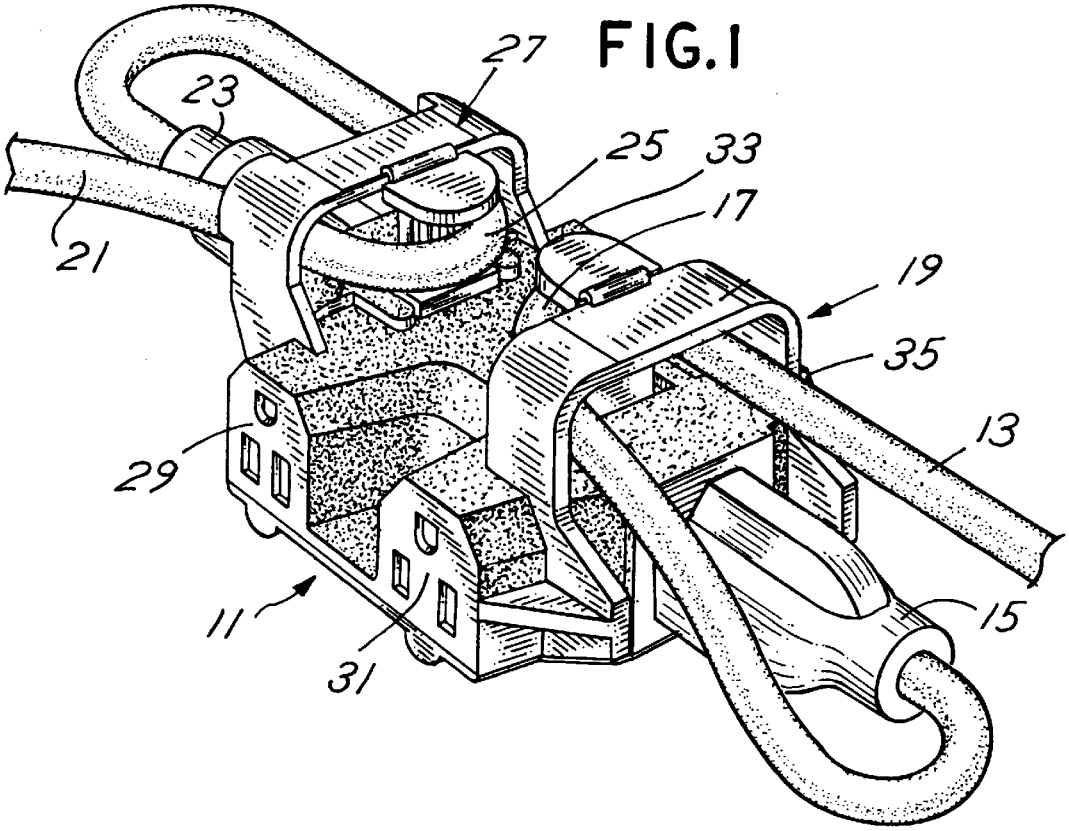
FIG. 1 is a perspective view of an embodiment of a cord securement device of the present invention with a pair of pivoting gates in a cord securement position, and with two electrical cords connected to both the male and female securement-capable plugs and sockets.
Figure 2:
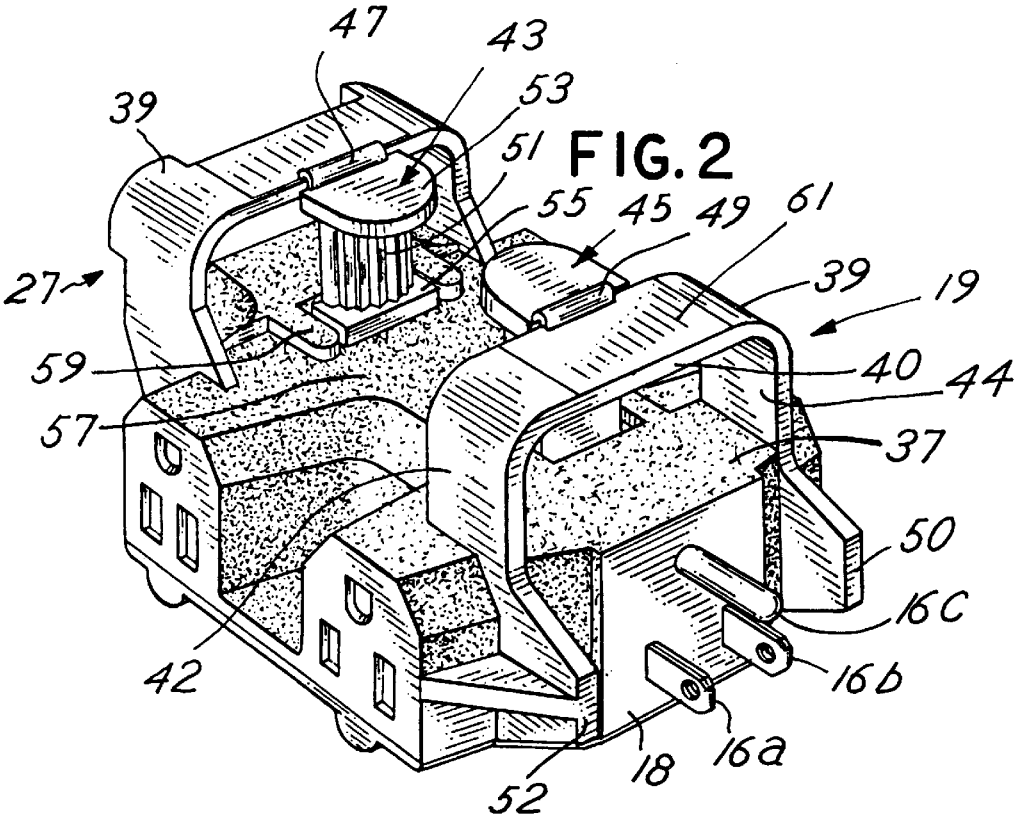
FIG. 2 is a is a perspective view of the cord securement device of FIG. 1 with the pivoting gates in the cord securement position without any connected electrical cords.

Referring to FIGS. 1–4, an electrical tap 11 provides a plurality of outlets for supplying power. Tap 11 receives power from a conventional electrical extension cord 13 which is connected at its opposite end (not shown) to an external power source such as a generator or a conventional electrical wall outlet. The female end 15 of the electrical cord 13 is plugged directly into a set of male blades 16*a* 16*b*, 16*c* (FIG. 2). Blades 16*a–c* are conventional in shape and size, and extend from a flat surface 18 formed at one end of tap 11. A loop 17 of the electrical cord is urged through an eyelet 19 in order to secure the electrical cord to the tap and prevent the female end 15 from being pulled from the blades as the cord 13 or tap 11 is moved about.

Figure 4:
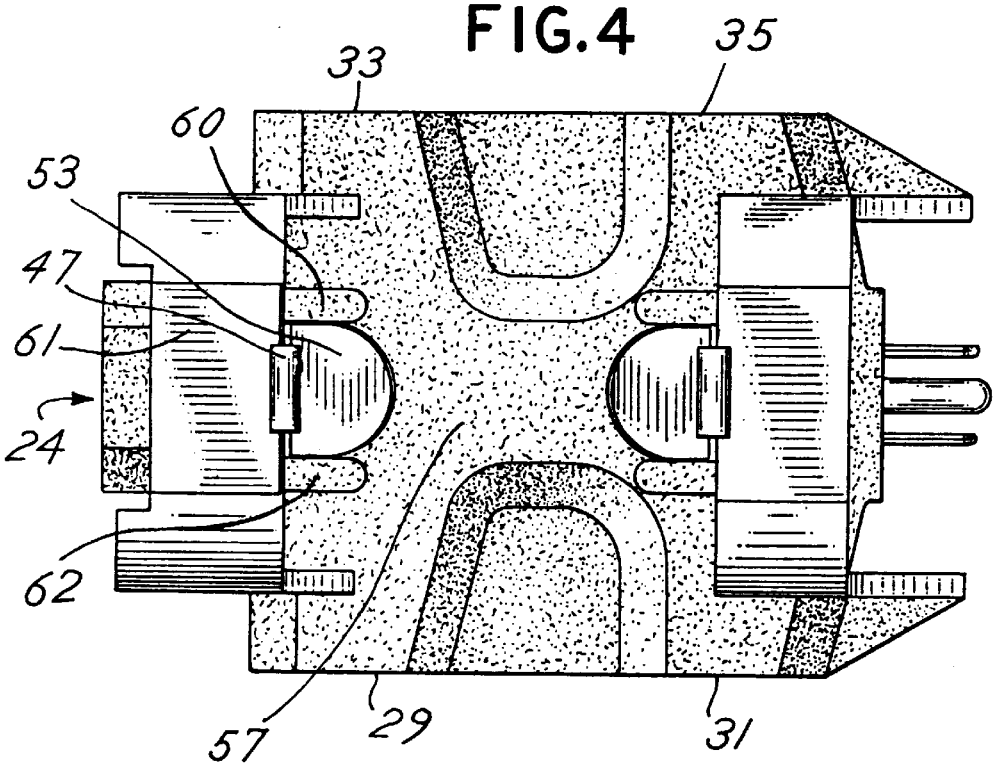
FIG. 4 is a top view of the cord securement device of FIG. 1 with both pivoting gates in the closed position without any connected electrical cords.

Electrical power may be tapped from tap 11 by, for example, another electrical cord 21. The male end 23 of the electrical cord 21 is plugged into a female recepticle 24 (FIG. 4). Receptacle 24 includes conventional blade sockets (not shown) for receiving a conventional plug 23. A loop 25 of the electrical cord 21 is urged through another eyelet 27 for securing cord 21 to the tap.

Tap 11 includes four additional female sockets 29, 31, 33, 35 which provide electrical power to additional cords, if desired. The sockets are conventional and arranged in pairs on each side of tap 11. All five female sockets 24, 29, 31, 33, 35 are of similar construction.

Figure 3:
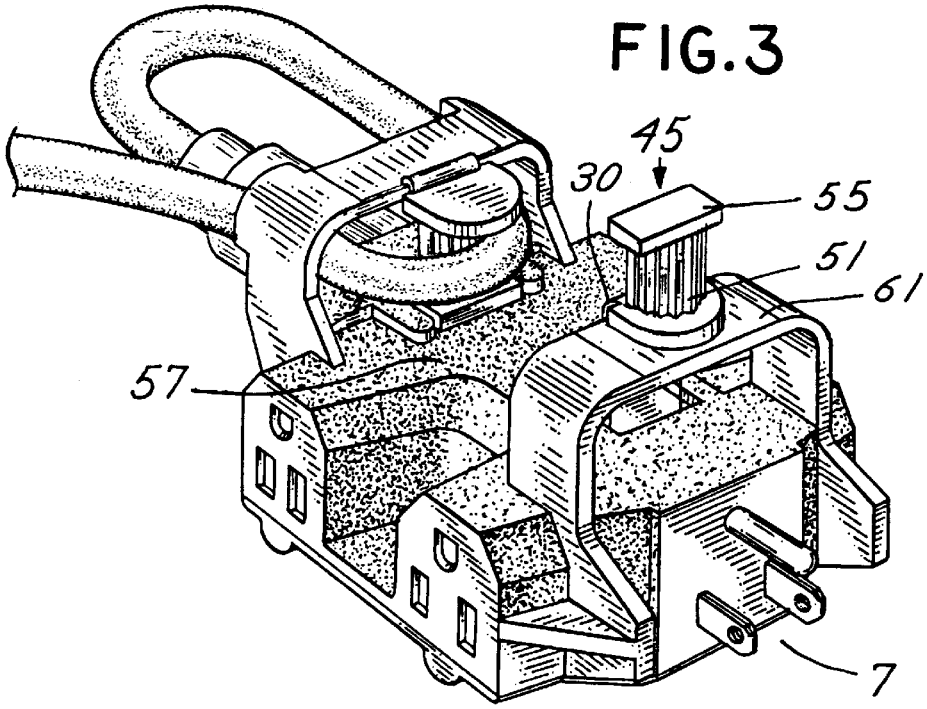
FIG. 3 is a is a perspective view of the cord securement device of FIG. 1 with the pivoting gate associated with the female securement-capable socket in the secured position and with the pivoting gate associated with the male securement-capable plug in an open position.

Referring to FIG. 2, each eyelet 19, 27 is formed of a flat planar surface 37 and an inverted U-shaped wall member 39. Planar surface 37 is disposed in a generally horizontal plane when the tap is at a rest position as shown in FIGS. 1–3. Inverted U-shaped wall member 39 includes a top member 40 positioned above surface 37 and a pair of side members 42, 44 extending from top member 40 to planar surface 37. In addition, side members 42, 44 may extend below surface 37 to form protection walls 50, 52. Walls 50, 52 extend along each side of blades 16*a–c* to protect the blades.

As shown in FIG. 2, a pair of pivoting tabs or gates 43, 45 are attached to the top member of a respective U-shaped member 39 by a respective living hinge 47, 49. The hinge 47, 49 allows the gate to be pivoted 180 degrees between an open position, shown in FIG. 3, and a closed position, shown in FIG. 2. When the gate is in its open position, the loop of an electrical cord may pass through the eyelet. Once the loop passes through the eyelet, the gate is then rotated into its closed position. The gate is rotated through the center of the loop so as to capture the loop between the U-shaped wall member and the flat planar surface 37, blocking the loop from removal back out of the eyelet.

Gates 43, 45 are formed of a semi-cylindrical middle member 51, a top member 53 and a bottom member 55. Bottom member 55 is rectangular in configuration (FIG. 3) and prevents the pivoting gate from opening by developing frictional contact with planar surface 37. A second flat planar surface 57 is disposed parallel to and slightly above planar surface 37. A groove area 59 is formed in the upper planar surface and two extended ears 60, 62 (FIG. 4) are sized relative to bottom member 55 so as to frictionally mate with the edges of bottom member 55 in order to keep the gate in its closed position. Also, as will be understood, tension from the secured cord maintains the gate in its closed position.

Middle member 51 has a ribbed semi-cylindrical outer surface. The ribs extend perpendicular to the planar surface 57. While the device is in use, the secured electrical cord maintains contact with the semi-cylindrical middle member 51. The vertical motion of the secured cord is constrained by the top member of the gate 53 which has a larger radius extent than middle member 51 and by planar surface 57. Lateral motion of the electrical cord is constrained by the eyelet. In the open position, the gate is rotated 180° so that the top member 45 of the gate is placed in contact with the upper surface of the top member 40 of the U-shaped member. The bottom member 55 of the gate is vertically superior when in the open position and extends above the eyelet, as shown in FIG. 3.

Tap 11 is a practical construction that will maintain an electrical connection between electrical cords 13, 21, without imposing undue strain on the male and female cord ends 15, 23. In addition, the tap 11 may be easily manufactured at a low cost from commercially available materials. For example, tap 11 may be molded from plastic. A separate inner mold of polycarbonate plastic or equivalent (not shown) may contain the electrical connectors, blades bars and wires, etc. and an outer mold of the structure shown in FIGS. 1–4 may be of polyvinyl chloride (PVC). Moreover, tap 11 is relatively resistant to damage and also prevents electrical cords 13, 21, from becoming worn or damaged. In addition, the tap 11 allows the connection of male and female cord ends 15, 23 to the tap to be visually inspected.

Although the preferred embodiment described above is fashioned by sealing together two plastic molds and utilizes metallic wire or other conductors for its internal electrical connections, several other methods of construction and several other modes of electrical connection immediately suggest themselves to those skilled in the art. For instance, with respect to the casing, the plastic casing may be molded around the internal connectors as a single mold or molded of several pieces, or in different configurations, or an insulating material other than plastic may be used. With respect to the internal electrical connection, various methods such as conductor bus bars, conducting metallic slabs, or alternative wiring configurations are immediately apparent to those skilled in the art.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

Many modifications and variations of the present invention are possible in light of the above teachings. Thus, it is to be understood that, within the scope of the appended claims, the invention may be practiced otherwise than as described hereinabove.

What is claimed and desired to be secured by Letters Patent is:

1. An electrical tap which prevents separation of an electrically connected power cord comprising:

a base member having a plurality of electrical sockets and a linking electrical plug, said linking electrical plug adapted to connect to a receptacle end of a first linking power cord for supplying electrical power to the electrical tap; and a first electrical cord securement mechanism connected to said base member, said first securement mechanism receiving a loop of the first linking power cord for maintaining electrical connection between the first linking power cord and said base member.

2. The electrical tap of claim 1 and further comprising a second cord securement mechanisms.

3. The electrical tap of claim 1 wherein said linking electrical plug comprises male prongs, said electrical tap further comprising a protection wall to protect said male prongs.

4. The electrical tap of claim 1 wherein said electrical plug is the sole electrical plug.

5. The electrical tap of claim 1 wherein said first securement mechanism comprises an eyelet secured to said base member defining an opening sized to receive a loop of the first linking power cord, and a locking member, the first linking power cord being secured to said base member by means of said locking member.

6. The electrical tap of claim 5 wherein said locking member comprises a hinged gate which allows passage of the loop of first linking power cord when in an open position, but prevents the loop of first linking power cord from passing out of the tap when in a closed position.

7. The electrical tap of claim 1 wherein said base member further comprises a linking electrical socket adapted to connect to a plug end of a second linking power cord.

8. The electrical tap of claim 7 wherein said linking electrical socket is located opposite said linking electrical plug, said linking electrical plug and said linking electrical socket defining a main axis of said electrical tap.

9. The electrical tap of claim 8 wherein said plurality of electrical sockets comprise four electrical sockets positioned transverse to the main axis in two opposing sets of two.

10. The electrical tap of claim 8 and further comprising a second electrical cord securement mechanism connected to said base member, said first securement mechanism receiving a loop of the first linking power cord for maintaining electrical connection between the first linking power cord and said linking electrical plug, said second securement mechanism receiving a loop of a second linking power cord for maintaining electrical connection between the second linking power cord and said linking electrical socket.

11. The electrical tap of claim 10 wherein said first securement mechanism and said second securement mechanism each comprise a hinged gate which allows passage of a loop of electrical cord when in an open position, but prevents the loop of electrical cord from passing out of said electrical tap when in a closed position.

12. The electrical tap of claim 11 wherein said plurality of electrical sockets comprise four electrical sockets positioned transverse to the main axis in two opposing sets of two.

13. An electrical tap which prevents separation of an electrically connected power cord comprising:

a base member having a plurality of electrical sockets; and an electrical cord securement mechanism connected to said base member, said securement mechanism receiving a loop of an electrical cord for maintaining electrical connection of the respective electrical cord with said base member, said securement mechanism comprising:

an eyelet secured to said base member defining an opening sized to receive a loop of the electrical cord; and a locking member for securing the electrical cord to said base member, said locking member comprising a hinged gate which allows passage of the loop of electrical cord when in an open position, but prevents the loop of electrical cord from passing out of said electrical tap when in a closed position.

* * * * *